US005599431A

United States Patent [19]

Scorpio

[11] Patent Number: 5,599,431

[45] Date of Patent: Feb. 4, 1997

[54] ELECTROPLATING SOLUTION BARRIER DEVICE

[75] Inventor: Paul B. Scorpio, Coventry, R.I.

[73] Assignee: Metfab Sales & Service, Inc., Warwick, R.I.

[21] Appl. No.: 634,240

[22] Filed: Apr. 18, 1996

[51] Int. Cl.[6] ..... C25D 17/00

[52] U.S. Cl. ..... 204/279

[58] Field of Search ..... 204/202, 279, 204/203, 207, 281

[56] References Cited

U.S. PATENT DOCUMENTS 2,737,488 3/1956 Gray ..... 204/279 X 3,535,222 10/1970 Cooke et al. ..... 204/207

4,278,520 7/1981 Turner ..... 204/207

4,619,751 10/1986 Robinson ..... 204/279

*Primary Examiner*—Donald R. Valentine

*Attorney, Agent, or Firm*—Richard D. Zimmerman

[57] ABSTRACT

An electroplating solution barrier device with a rubber solution barrier having a seam, the solution barrier being removably inserted in a stabilizer with an opening and a channel. The solution barrier seam is aligned with the stabilizer opening. Guide pins traverse the channel and solution barrier. The stabilizer, solution barrier and guide pin combination is removable attached to a conventional reel-to-reel electroplating container to provide economic and efficient retention of solution in reel-to-reel electroplating processes.

4 Claims, 2 Drawing Sheets

ELECTROPLATING SOLUTION BARRIER DEVICE

TECHNICAL FIELD

The technical field of this invention concerns devices used in electroplating.

BACKGROUND OF THE INVENTION

Electroplating is the process of depositing metals on conductive surfaces using electricity. Conventional electroplating processes involve cleaning, etching, plating, and post-plating treatment, including drying, of objects to be plated. The steps are generally accomplished in containers or tanks of varying sizes which contain various solutions including acids, bases, and electrolytes.

One form of electroplating is the reel-to-reel or continuous strip plating method. In reel-to-reel plating, frequently used in plating electronic components, the material to be plated is ordinarily provided on a feed coil. The feed coil is unreeled and processed through the conventional stages including cleaning, etching, plating, and post-plating treatment. The plated material is then rewound on a reel and is ready for further processing. An advantage of reel-to-reel plating is that the plated material is passed through the process in a continuous strip or feed, and labor-intensive handling of the material is minimized.

The reel-to-reel method is generally practiced with the material to be plated passing through a series of containers or tanks containing various solutions to accomplish the stages in the plating process. As the material passes from one tank into another, it is necessary to remove as much of the solution as possible from the material to be plated to preserve expensive solutions and avoid contamination of the solutions used in subsequent stages.

Current methods vary widely in their development and may include technology as basic as wedging paper towels or absorbent paper materials against the moving strip of material, or wedging strips of expanded polypropylene against the moving material. These methods also fail to maintain the stability of the absorbent or other material placed in contact with the moving material to be plated. The rapidly moving material causes similar rapid movements of the absorbent or other material, resulting in inefficient operations since the material must be adjusted or replaced frequently. The lack of stability also can result in irregular and inconsistent removal of solution from the moving material to be plated.

No currently marketed device is known to this applicant that maintains the stability of the solution barrier and that provides efficient removal of excess solution from the rapidly moving material to be plated, while providing a barrier to reduce solution leakage, that does not damage excessively the material to be plated, and that has a reasonably long life to reduce expense and inefficiencies in frequent replacement of the materials.

SUMMARY OF THE INVENTION

The present invention is directed to the technical problems of the uneconomic and inefficient current methods. An electroplating solution barrier device having features of the present invention comprises a solution barrier, a stabilizer and guide pins, the solution barrier being removably inserted in the stabilizer. The stabilizer has an opening through which the material to be plated passes.

A channel surrounds the stabilizer opening, and the solution barrier is positioned in the stabilizer channel. Guide pins are placed in guide pin holes passing through the stabilizer and the solution barrier in the channel. The solution barrier contains a seam which is aligned with the stabilizer opening so that material to be plated passes through the stabilizer opening and the solution barrier seam. The entire device is removably attached by conventional means to a conventional reel-to-reel electroplating container so that the opening in the container through which the material to be plated passes is aligned with the stabilizer opening and the solution barrier seam.

BRIEF DESCRIPTION OF THE DRAWINGS

These and other features, aspects and advantages of the present invention will become better understood with regard to the following description, appended claims and drawings where:

DESCRIPTION OF THE BEST MODE

Figure 1:
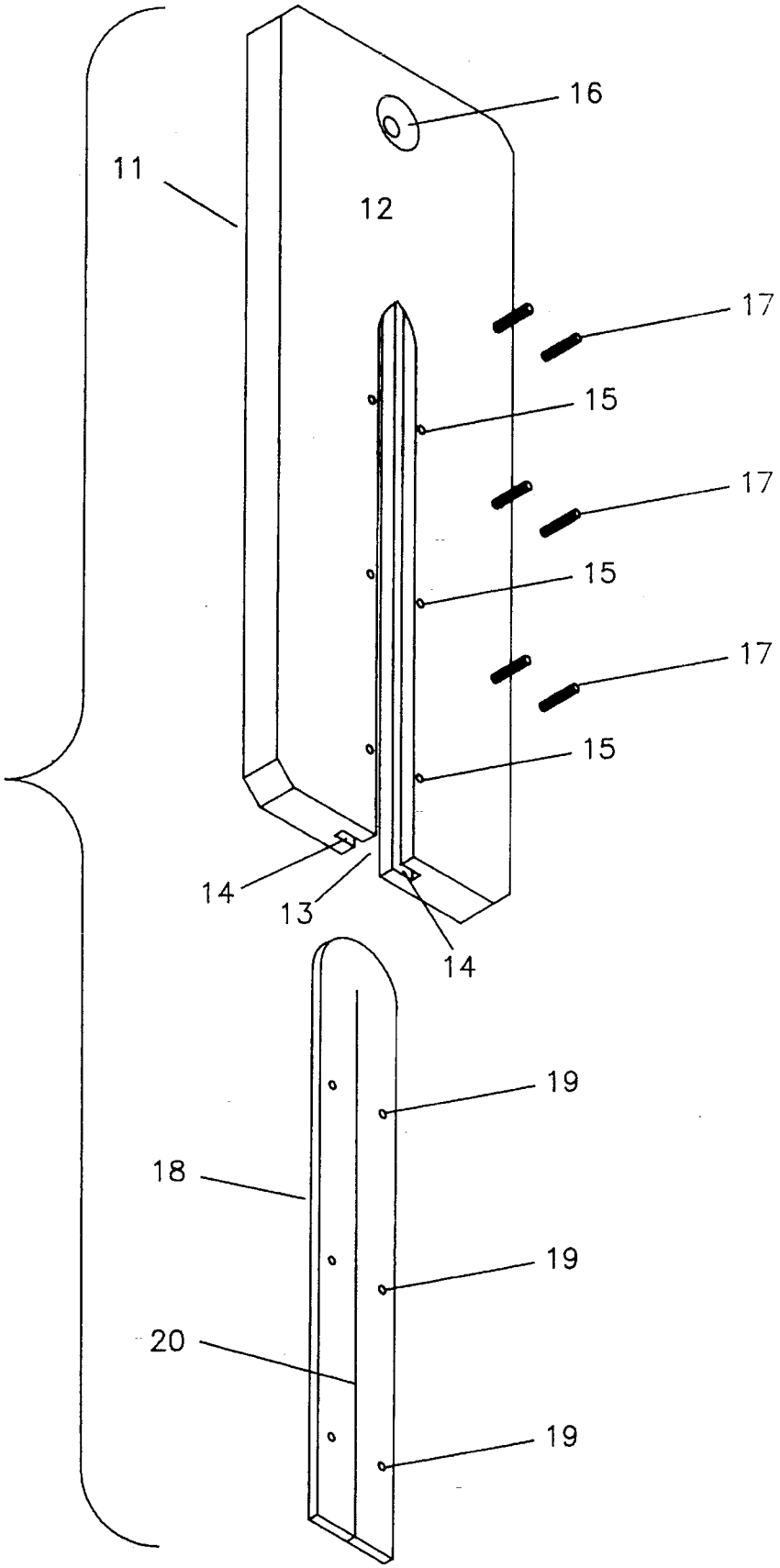
FIG. 1 shows an exploded perspective view of the electroplating solution barrier device.
Figure 4:
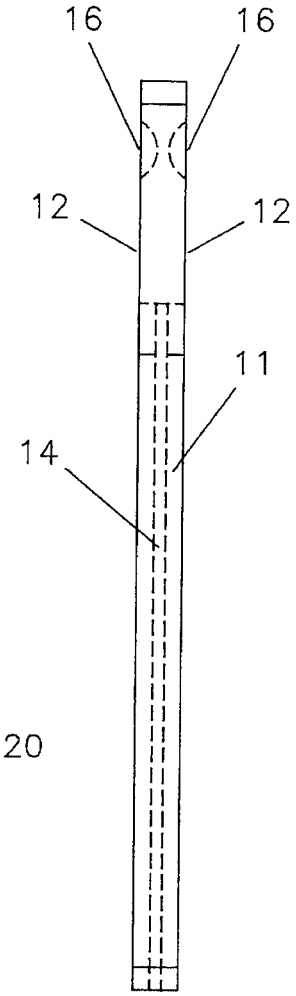
FIG. 4 shows a side plan view of the stabilizer.
Figure 5:
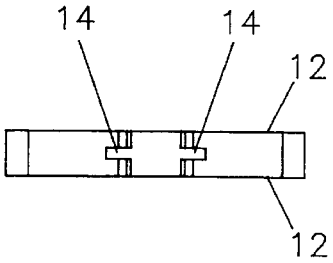
FIG. 5 shows a top plan view of the stabilizer.

As shown in FIG. 1, an electroplating solution barrier device comprises a stabilizer 11, a solution barrier 18 and guide pins 17. The stabilizer has opposing faces 12, an opening 13 for the material to be plated to pass through, a channel 14 around the opening, and stabilizer guide pin holes 15. As shown in FIG. 4, the stabilizer may have grip recesses 16 on opposing faces (12) to facilitate manual gripping of the device.

The stabilizer (11) is composed of a material that can resist the caustic effects of solutions used in electroplating stages, and preferably is of a material that is easily cut, machined and otherwise shaped. The preferred material is polyethylene of approximately ½ inch thickness. Other suitable materials include polypropylene, chloropolyvinyl chloride, polyvinyl chloride, styrene, polystyrene, acrylonitrile-butadiene-styrene, fiberglass and phenolic laminates.

The opening (13) is sized depending on the size of material to be plated and the size of the solution barrier (18). One embodiment uses an opening of approximately ½ inch as measured traversely across the opposing faces (12). The channel (14) in this embodiment is centered between opposing faces (12), is approximately ⅛ inch in height as measured in a plane perpendicular to the opposing faces (12), and the channel extends approximately 3/10 inch beyond the ½ inch opening (13), as measured in a plane parallel to the opposing faces (12) and traverse to the longitudinal axis of the stabilizer (11). The opening (13) extends approximately 7 inches along the longitudinal axis of the approximately 10 inch stabilizer (11). The opening (13) is open on one end to allow insertion of the solution barrier (18) and to reduce manufacturing costs.

As shown in FIG. 1, there are 6 approximately 3/32 inch diameter stabilizer guide pin holes (15) in this embodiment, three on each side of the opening (13), a first pair of which is spaced approximately 1 1/16 inches from the open end of the opening (13), and on either side of the opening, and the other pairs approximately 2 ¼ inches and 4 ½ inches respectively from the first pair of stabilizer guide pin holes (15) and on either side of the opening (13).

Figure 2:
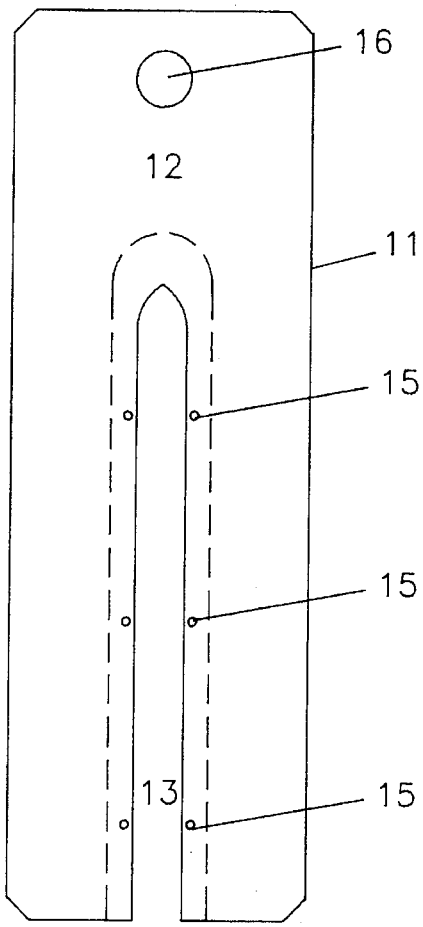
FIG. 2 shows a front plan view of the stabilizer.
Figure 3:
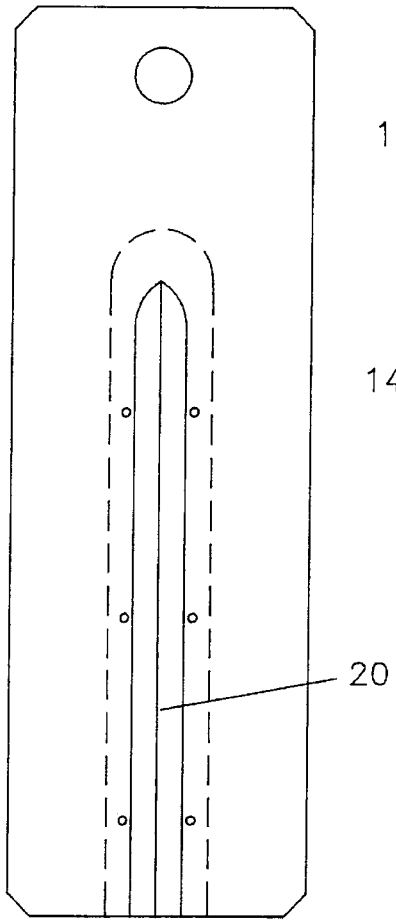
FIG. 3 shows a front plan view of the stabilizer and the solution barrier combination.

As shown in FIGS. 1 and 2, the solution barrier (18) is a flexible, die cut rubber, preferably silicon rubber, sized to fit the channel (14). The solution barrier (18) is cut longitudinally approximately on its center line to form a seam 20 which is aligned with the opening (13), allowing the article to be plated to pass through the opening (13) and the seam (20). The solution barrier (18) has a plurality of solution barrier guide pin holes 19 spaced to line up with the stabilizer guide pin holes (15) when the solution barrier (18) is inserted in the channel (14). The solution barrier (18) is friction fit in the channel (14) with sufficient contact to render the junction between the solution barrier and channel resistant to the passage of liquids.

The soft flexible rubber solution barrier (18) minimizes damage to the material to be plated, efficiently removes solution from the rapidly moving material to be plated, reduces solution leakage and resulting solution loss and contamination, and has a comparatively long useful life, which reduces costs and inefficiencies associated with frequent replacement of currently used devices. The stabilizer (11) holds the solution barrier (18) in a sufficiently stable position relative to the moving material to be plated to reduce irregular and inconsistent performance of the solution barrier (18) and to reduce the frequency of adjustment and replacement of the solution barrier.

As shown in FIG. 1, the guide pins 17 are sized to friction fit in the stabilizer guide pin holes (15) and the solution barrier guide pin holes (19), and in the embodiment discussed above are approximately 3/32 inch in diameter and ½ inch long and made of polypropylene. The guide pins could be made of any materials suitable for the stabilizer (11).

I claim:

1. An electroplating solution barrier device comprising a rectangular planar polyethylene stabilizer having opposing faces, an opening through which articles to be electroplated can pass, a rectangular channel surrounding the opening, and a plurality of cylindrical stabilizer guide pin holes extending through the opposing faces and passing through the channel;

a silicon rubber solution barrier removably fitted in liquid resistant contact in the channel, the solution barrier having a plurality of solution barrier guide pin holes matched to the stabilizer guide pin holes, and a liquid resistant seam through which articles to be electroplated can pass, the seam being aligned with the opening to permit articles to be electroplated to pass; and a plurality of cylindrical polyethylene guide pins removably inserted in the stabilizer guide pin holes and through the solution barrier guide pin holes.

2. An electroplating solution barrier device comprising a stabilizer having an opening through which articles to be electroplated can pass, a channel surrounding the opening, and a plurality of stabilizer guide pin holes passing through the channel;

a solution barrier removably fitted in liquid resistant contact in the channel, the solution barrier having a plurality of solution barrier guide pin holes matched to the stabilizer guide pin holes, and a liquid resistant seam through which articles to be electroplated can pass, the seam being aligned with the opening to permit articles to be electroplated to pass; and a plurality of guide pins removably inserted in the stabilizer guide pin holes and through the solution barrier guide pin holes.

3. The electroplating solution barrier device of claim 2 in which the stabilizer is made of a plastic resistant to solutions used in the electroplating process.

4. The electroplating solution barrier device of claim 2 in which the stabilizer is made of one of the following materials: polypropylene, chloropolyvinyl chloride, polyvinyl chloride, styrene, polystyrene, acrylonitrile-butadiene-styrene, fiberglass or phenolic laminates.

* * * * *